United States Patent [19]

Wood

[11] 4,023,649

[45] May 17, 1977

[54] SAFETY LOCK DEVICE FOR LIFTS

[75] Inventor: Ralph R. Wood, Florissant, Mo.

[73] Assignee: Wyle Laboratories, El Segundo, Calif.

[22] Filed: Oct. 3, 1975

[21] Appl. No.: 619,205

[52] U.S. Cl. ..... 187/8.49; 248/188.2; 248/356; 403/104; 403/374

[51] Int. Cl.[2] ..... B66F 7/28

[58] Field of Search ..... 187/1 R, 8.47, 8.49, 187/8.5, 73, 80; 403/104, 106, 109, 374, 377; 248/188.2, 356, 337, 412, 411

[56] References Cited

UNITED STATES PATENTS

| | | | |
|---|---|---|---|
| 453,865 | 6/1891 | Johnson | 248/337 |
| 2,684,129 | 7/1954 | Jaseph | 187/8.49 |
| 2,956,644 | 10/1960 | Green | 187/8.49 |
| 3,228,647 | 1/1966 | Musianowycz | 248/412 |
| 3,833,091 | 9/1974 | Mac Pherson | 248/411 X |

FOREIGN PATENTS OR APPLICATIONS

| | | | |
|---|---|---|---|
| 1,138,172 | 12/1968 | United Kingdom | 248/412 |

*Primary Examiner*—Evon C. Blunk
*Assistant Examiner*—James L. Rowland
*Attorney, Agent, or Firm*—Fay & Sharpe

[57] ABSTRACT

A safety lock device for lifts or the like includes a pair of elongated inner and outer members. The inner member is movable longitudinally relative to the outer member between a retracted position and a plurality of extended positions. The lock device includes friction brake means carried by the inner member for automatically locking the inner member against movement toward its retracted position from any extended position. The brake means provides free extending movement of the inner member from its retracted position to its extended positions. A selectively operable releasing means is movable from a brake armed position to a brake releasing position for providing movement of the inner member from any of its extended positions to its retracted position. Operating means automatically move the releasing means to its brake armed position upon movement of the inner member from its retracted position toward its extended positions.

10 Claims, 4 Drawing Figures

SAFETY LOCK DEVICE FOR LIFTS

BACKGROUND OF THE INVENTION

This invention pertains to the art of safety lock devices and, more particularly, to safety lock devices of the type for automatically locking an inner elongated member against movement toward a fully telescoped position within an outer member. The invention is particularly applicable for use on vehicle lifts or the like and will be described with reference thereto. However, it will be appreciated that the invention has broader aspects and the safety lock device may be used on other apparatus having longitudinally movable inner and outer members, such as telescoping ladders or cranes, or the like.

Vehicle lifts or the like commonly include a supporting platform which is raisable and lowerable by operation of a fluid cylinder. The supporting platform is selectively elevated to any desirable elevated position by operation of the fluid cylinder. The elevation to which the platform is raised depends upon the work to be done on the vehicle supported by the platform, and upon the personal desires of the person doing the work.

In devices of the type described, a safety lock is provided for preventing lowering movement of the platform from its elevated position in the event of a failure in the fluid cylinder, or in the event the lowering control for the fluid cylinder is accidentally operated while a workman is beneath the platform. One old type of safety device simply comprises a bar pivoted to the platform for movement to a vertical position for preventing lowering movement of the platform from its fully elevated position. A safety device of this type is inoperative when the platform is raised to elevations less than the highest elevation.

In order to prevent lowering movement of a platform from any of a plurality of elevated positions, many different types of safety lock devices have been proposed. For example, U.S. Pat. No. 1,938,191 issued Dec. 5, 1933, to Metz, et al. discloses a safety lock device which is cooperable with the elevating fluid cylinder. A cam ring surrounding the inner member of the fluid cylinder receives a plurality of balls which are cammed into firm engagement with the inner member of the fluid cylinder for preventing lowering movement thereof unless the cage carrying the balls has been manually elevated to prevent camming engagement of the balls with the inner member. Balls essentially make point contact with the inner member and place high stress concentrations thereon. In addition, balls have a tendency to easily slip upwardly on the cam ring or to rotate so the inner member may not be firmly locked against lowering movement. The safety lock device in Metz is exposed externally so it is subject to damage, and can accumulate significant amounts of dirt and grease. It would be more desirable to have a safety lock device carried by the inner member internally of an outer member for somewhat protecting the safety lock device from damage, and from accumulating significant quantities of dirt and grease. The Metz lock device is manually released by pulling on a cable for rotating the ball cage which then cooperates with cams on the cam ring for vertically lifting the ball cage. The cable must be constantly tensioned while the lift is lowered so there is no stable releasing position. Wrapping the cable around a fixed member for lowering the lift could result in a safety hazard when the lift is again elevated if a workman forgets to release the cable. It would be desirable to have a safety lock device which is automatically armed upon movement of the lift from any elevated position to a retracted position so that it will be automatically operated upon the next elevating movement on the lift.

Other prior patents of interest include U.S. Pat. No. 2,608,381 issued Aug. 26, 1952, to Pelouch who discloses a lever which is spring biased to a locking position. However, movement of the lever to its locking position requires manual movement of a pivoted locking member and the lever is only for locking the lift in its fully elevated position.

U.S. Pat. No. 2,684,129 issued July 20, 1954, to Jaseph discloses a locking device having a spring biased pivoted lever for moving locking members into and out of their locking positions. The Jaseph device also locks only in the fully elevated position of the lift.

U.S. Pat. No. 2,849,084 issued Aug. 26, 1958 to Hott, et al. discloses a safety lock device including an elongated ratchet cooperating with a pivoted pawl for locking the lift in any elevated position. Arrangements of this type are very expensive due to the necessity of making a toothed ratchet which must have hardened teeth. The impact load on the pawl and teeth is extremely high in the event of a failure in the elevating mechanism.

U.S. Pat. No. 2,954,100 issued Sept. 27, 1960, to Harr discloses a safety lock device including toothed tubular member cooperable with a pivoted pawl. In the Harr device, the pivoted pawl and its mechanism are externally exposed so they are subject to damage, along with accumulation of dirt and grease which may prevent reliable operation. In addition, the teeth on the tubular member are relatively widely spaced so a great impact load would be imposed upon the teeth and the pawl in the event of a failure in the elevating mechanism. Manufacture of a toothed tubular member is also very expensive.

U.S. Pat. No. 2,956,644 issued Oct. 18, 1960, to Greene discloses a safety lock device which is engaged only at the uppermost elevated position of the lift. The locking device is spring biased to a locking position upon elevation of the lift but engages only upon substantially full elevating movement of the lift.

Other patents of interest for locking devices which are engaged upon elevation of a vehicle lift include: Racely—U.S. Pat. No. 3,013,635 issued Dec. 19, 1961; Jaseph—U.S. Pat. No. 3,056,468 issued Oct. 2, 1962; Wallace, et al.—U.S. Pat. No. 3,098,542 issued July 23, 1963; and, Quatkemeyer—U.S. Pat. No. 3,363,724 issued Jan. 16, 1968. In these patents, a locking lever is moved to a locking position upon movement of the lift to its elevated position. However, the locking devices are not capable of locking the lift in any elevated position in the event of a failure in the lifting mechanism. Vehicle lifts of the type described may be operated in such a manner that they are elevated above a supporting surface between positions wherein a mechanic can work on a vehicle while lying on his back, and a position wherein the mechanic can work on the vehicle while standing.

SUMMARY OF THE INVENTION

A safety lock device for vehicle lifts or the like includes elongated inner and outer members. The inner member is longitudinally movable relative to the outer member between a retracted position and a plurality of extended positions. The locking device includes friction brake means for automatically preventing lowering movement of the inner member toward its retracted position from any elevated position.

In a preferred arrangement, the friction brake means is carried by the inner member, and is movable generally radially inwardly and outwardly relative to the longitudinal axis of the members. Cooperating cam means on the brake means and the inner member automatically moves the brake means into locking engagement with the outer member upon initial movement of the inner member from any extended position toward its retracted position.

In one arrangement, the brake means includes a plurality of arcuate brake segments carried on an elongated rod positioned within the inner member. The inner member has a cam plug cooperable with the brake segments for shifting same generally radially outwardly into locking engagement with the outer member upon initial movement of the inner member from any extended position toward its retracted position.

Releasing means is provided for allowing disengagement of the brake means to provide movement of the inner member from any extended position to its retracted position. The releasing means is movable between brake releasing and brake armed positions, and movement of such releasing means to its brake releasing position will move the brake means longitudinally away from the inner member and its cooperating cam means.

Yieldable biasing means is provided for yieldably biasing the brake means into engagement between the inner and outer members. The yieldable biasing means will yield during upward extending movement of the inner member relative to the outer member for allowing slight inward movement of the brake segments.

Operating means is provided for automatically moving the releasing means from its brake disengaged position to its brake armed position upon movement of the inner member from its retracted position toward its extended positions. In one arrangement, the operating means is movable between operating and operated positions. Once the brake releasing means is manually moved to its brake disengaged position for movement of the inner member to its retracted position, the operating means is moved to its armed operating position when the inner member moves to its fully retracted position. Upon extending movement of the inner member from its retracted position, the operating means automatically moves to its operated position and moves the releasing means to its brake armed position.

The brake releasing means includes an elongated rod positioned within the inner member and pivotally connected to a lever which in turn is pivotally connected to the inner member. The lower end portion of the rod carries the brake means, and the rod is biased by yieldable biasing means in a direction for normally engaging the brake means. Movement of the lever to a brake releasing position moves the pivot connection between the rod and lever to an over center position relative to the pivot axis of the lever so the releasing means is in a stable brake disengaged position for lowering movement of the lift. Torsion spring means surrounding the pivot axis of the lever is automatically torqued upon lowering movement of the inner member to its retracted position for biasing against the lever and moving same to the brake armed position upon extension movement of the inner member from its retracted position.

It is a principal object of the present invention to provide an improved safety lock device for vehicle lifts or the like.

It is a further object of the invention to provide an improved safety lock device which will automatically prevent lowering movement of a vehicle lift or the like from any elevated position in the event of a failure in the lifting mechanism.

It is also an object of the invention to provide an improved lift safety lock device which is very inexpensive to manufacture and assemble.

It is another object of the invention to provide a safety lock device which is automatically armed upon movement of the lift to its lowermost position.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF A PREFERRED EMBODIMENT

Figure 1:
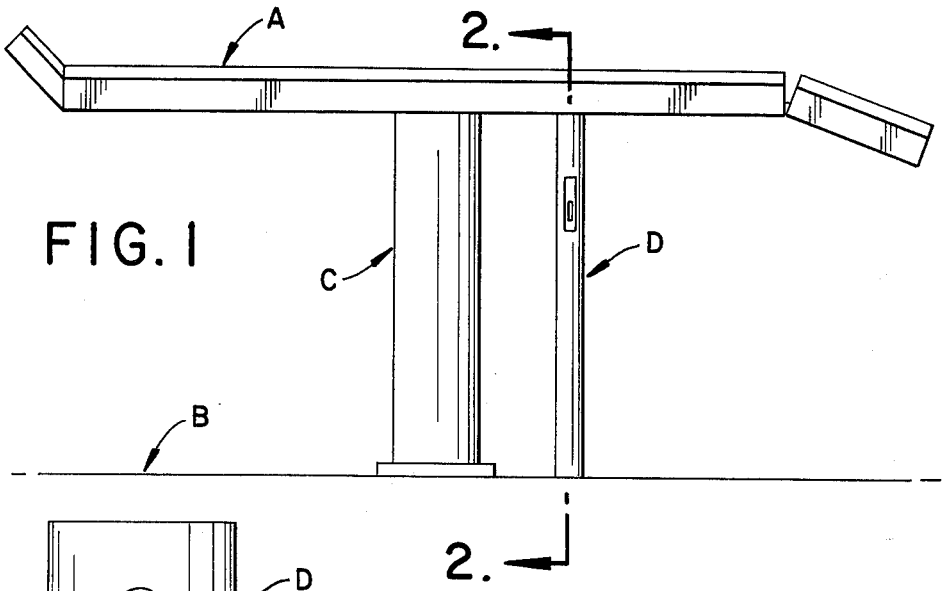
FIG. 1 is a side elevational view of a vehicle lift having the improved safety lock device of the present invention incorporated therein.

Referring now to the drawings wherein the showings are for purposes of illustrating a preferred embodiment of the invention only and not for purposes of limiting same, FIG. 1 shows a vehicle lift platform A raisable to a plurality of elevated positions above a supporting surface B such as a concrete floor, by selective operation of a fluid cylinder C. A safety lock device D is provided for preventing lowering movement of lift platform A from any elevated position above supporting surface B in the event of a failure in fluid cylinder C. Lift platform A may be of the type which engages the frame of a vehicle, or may be of the type on which a vehicle is driven.

Figure 2:
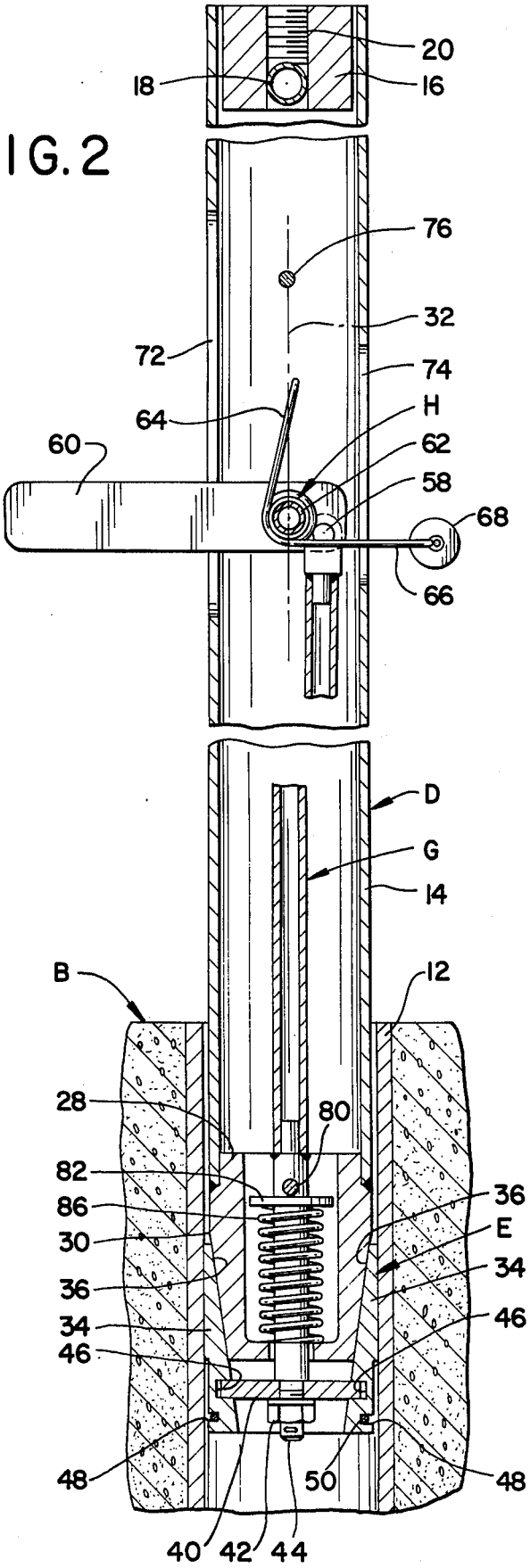
FIG. 2 is a partial cross-sectional elevational view taken generally along lines 2—2 of FIG. 1.

As shown in FIG. 2, safety lock device D includes an outer tubular member 12 embedded within supporting surface B and slidably receiving elongated inner tubular member 14. The outer end portion of inner member 14 receives an adapter 16 having a pin 18 extending therethrough, and through suitable holes in the upper end portion of inner member 14. Pin 18 may be peened at its opposite end for retaining same in member 14. A threaded bore 20 in adapter 16 provides means for connecting adapter 16 with lift A of FIG. 1. Obviously, any suitable means may be provided for connecting the upper end portion of inner tubular member 14 with lift platform A.

Inner member 14 has an inner end portion received within outer member 12 and has a cam plug 28 suitably secured thereto as by welding. Cam plug 28 has an outer surface 30 lying generally on the surface of a cone and tapering inwardly toward longitudinal axis 32 of members 12 and 14.

Brake means E is positioned between outer and inner members 12 and 14, and comprises a plurality of arcuate brake segments 34 having inner sloping cam surfaces 36 lying generally on the surface of a cone. The outer surfaces of brake segments 34 lie generally on the surface of a cylinder for engaging the inner cylindrical surface of outer member 12.

Brake segments 34 are carried by inner member 14 on the lower end portion of an elongated rod G. The lower end portion of rod G has a circular plate 40 secured thereto as by a nut 42 threaded onto the threaded reduced diameter lower end 44 of rod G. The outer peripheral portion of circular plate 40 is received in circumferential grooves 46 in brake segments 34. Outer circumferential grooves 48 in brake segments 34 receive a split metal ring 50 for holding brake segments 34 together with circular plate 40 engaged in grooves 46.

The diameter of the circle on which the bottoms of arcuate grooves 46 lie is substantially greater than the outer diameter of circular plate 40 to allow free movement of brake segments 34 radially inwardly and outwardly relative to longitudinal axis 32.

Surfaces 30 and 36 on cam plug 28 and brake segments 34 define cooperating cam means between inner member 14 and brake means E for moving brake means E into a locking position and preventing retraction of inner member 14 within outer member 12 from any extended position.

Elongated rod G positioned within inner member 14 is pivotally connected as by pin 58 with lever 60 which is pivotally connected to inner member 14 by pin 62. The pivot axis of pin 62 is coincidental with longitudinal axis 32. A torsion spring H is coiled about pin 62 on opposite sides of lever 60, and includes a first loop 64 and a second loop 66 carrying a roller 68. Lever 60 extends through an elongated vertical slot 72 in inner member 14 and second loop 66 extends through another elongated vertical slot 74 in inner member 14 opposite from slot 72. An abutment for lever 60 is defined by pin 76 extending through inner member 14 adjacent the upper end portion of slot 72 but spaced slightly downwardly therefrom.

The lower end portion of rod G has a pin 80 extending therethrough to form a stop for washer 82. Yieldable biasing means in the form of a coiled spring 86 is positioned between washer 82 and the lower inner surface of plug 28 for normally biasing rod G upwardly in FIG. 2. The upward movement provided to rod G by biasing means 86 normally moves brake means E upwardly relative to inner member 14 so that cooperating cam surfaces 30 and 36 move brake segments 34 generally radially outwardly relative to longitudinal axis 32 into relatively light engagement with the inner surface of outer member 12. During upward extending movement of inner member 14 relative to outer member 12, the frictional drag of brake segments 34 on the inner surface of outer member 12 causes biasing means 86 to yieldably elongate so that brake segments 34 can move generally radially inwardly relative to axis 32 and can also move longitudinally away from cam plug 28 so that free extension movement of inner member 14 is provided.

In the position of FIG. 2, the releasing means defined by lever 60 and rod G for selectively releasing brake means E is in its brake armed position. Connecting pin 58 between rod G and lever 60 is to the right of pin 62 and axis 32 so that biasing means 86 is biasing rod G upwardly to pivot lever 60 in a counterclockwise direction and move brake segments 34 toward cam plug 28 so that cooperating cam surfaces 30 and 36 move brake segments 34 radially outwardly into relatively light engagement with the inner surface of outer member 12. In this position of the releasing means, inner member 14 is free for extension movement relative to outer member 12 because the drag between brake segments 34 and outer member 12 will cause biasing means 86 to yield by elongating so that cam plug 28 moves away from brake means E for allowing slight radially inward movement of brake segments 34. In the event of a failure in fluid cylinder C of FIG. 1, or in the event the control for lowering cylinder C is operated while the safety lock device is in the position of FIG. 2, initial downward movement of inner member 14 relative to outer member 12 will cause outer cam surface 30 on cam plug 28 to engage inner cam surfaces 36 on brake segments 34 to bias such segments generally radially outwardly into firm locking engagement with the inner surface of outer member 12. This prevents further retraction movement of inner member 14 relative to outer member 12. As long as the lever 60 is in its generally horizontal brake armed position, brake means E will lock inner member 14 against retracting movement within outer member 12 from any extended position of inner member 14. The brake means is relatively protected because it is located within outer member 12, and it has been found that large amounts of oil and other lubricants will not preclude locking of inner member 14 relative to outer member 12 upon generally radially outward movement of brake segments 34.

Figure 3:
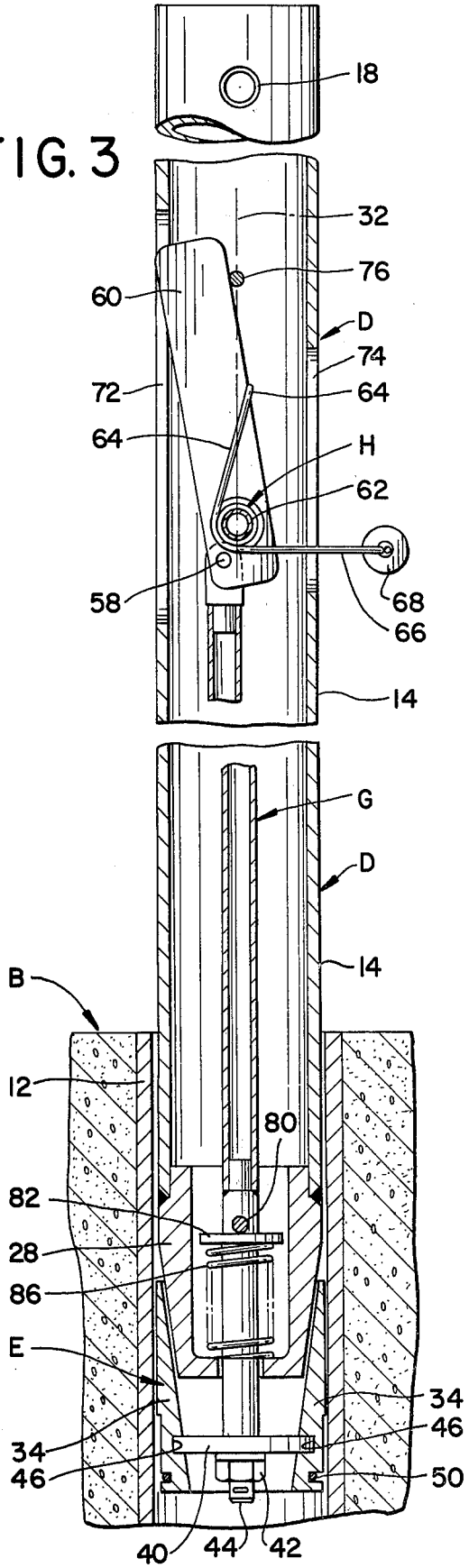
FIG. 3 is a partial cross-sectional elevational view similar to FIG. 2 and showing the locking device in a released position; and, FIG. 4 is a partial cross-sectional elevational view showing the position of the locking means when the inner member is fully retracted within the outer member.

In order to move the brake releasing means from its brake armed position to its brake releasing or brake disengaged position, lever 60 is manually pivoted clockwise in FIG. 2 to the position shown in FIG. 3. This moves pin 58 connecting rod G to lever 60 to the left of axis 32 as shown in FIG. 3 so that pin 58 is in an over center position with lever 60 bottomed against stop pin 76 under the biasing force of biasing means 86. Movement of lever 60 to the position shown in FIG. 3 moves brake means E longitudinally away from inner member 14 and cam plug 28 so that brake segments 34 are free to move generally radially inwardly for allowing free retracting movement of inner member 14 within outer member 12.

Figure 4:
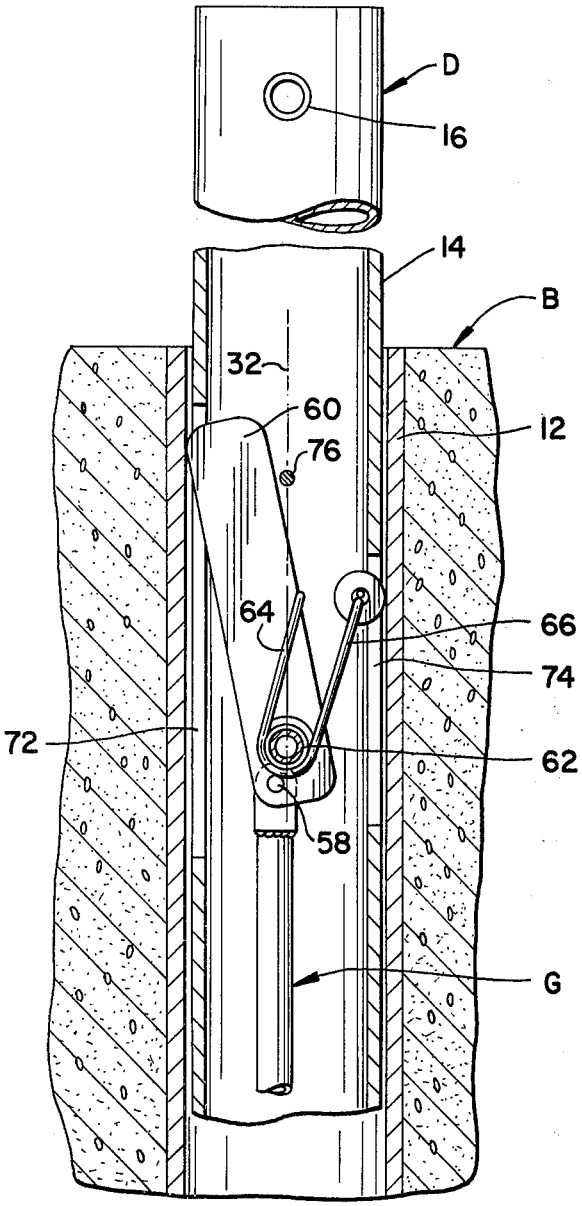

Once the releasing means is in the position shown in FIG. 3 and the control for fluid cylinder C of FIG. 1 is operated for lowering lift platform A, inner member 14 is free to retract within outer member 12 because brake means E is longitudinally moved out of engagement with cam plug 28. As inner member 14 approaches its fully retracted position within outer member 12, roller 68 on torsion spring H will contact supporting surface B for torquing spring H as shown in FIG. 4 so that first loop portion 64 is bearing against lever 60 and tending to bias same in a counterclockwise direction as viewed in FIG. 4. As long as inner member 14 is retracted within outer member 12, the outer end portion of lever 60 engages the inner surface of outer member 12 for holding lever 60 in position with pin 58 for rod G in an over center position to the left of axis 32. When fluid cylinder C of FIG. 1 is operated for elevating lift platform A, lever 60 will clear the outer end of outer member 12 first so that torsion spring H biases lever 60 to a generally horizontal position for moving pin 58 to the right of axis 32 so that brake means E is armed.

Torsion spring H defines an operating means which is movable between operating and operated positions. In the position of FIG. 2, operating means H is in its operated position, while in the position of FIG. 4 it is in its operating position. The operating means defined by torsion spring H automatically moves the releasing means defined by lever 60 and rod G from its brake releasing position to its brake armed position of FIG. 2. The operating means defined by torsion spring H is stronger than biasing means 86 so that operating means H will positively move lever 60 from its position of FIG. 4 to the position of FIG. 2 upon extension movement of inner member 14.

In the arrangement shown and described, the pair of outer and inner members 12 and 14 are longitudinally movable relative to one another between retracted and extended positions. The brake means E is automatically operative upon initial movement between the members in one direction for locking the members against further relative movement in that one direction. The brake means provides free movement of the members relative to one another in an opposite direction. The releasing means defined by lever 60 and rod G allows free relative movement of the members in one direction when the releasing means is moved from its brake armed position to its brake disengaged position. The operating means defined by torsion spring H is movable between the operated position shown in FIG. 2 and the operating position shown in FIG. 4. The operating means defined by spring H is automatically moved to its operating position of FIG. 4 upon movement of inner member 14 to its retracted position within outer member 12.

Inner member 14 and brake means E are movable longitudinally relative to one another for moving brake means E between engaged and disengaged positions. Brake means E is effectively carried by inner member 14 adjacent the inner end portion thereof within outer member 12 by being attached to the lower end portion of rod G which in turn is connected with inner member 14 through lever 60.

Obviously, the improved brake device of the present application can be used in many other environments than vehicle lifts. The brake device can be used in telescoping lifts of any type, and can also be used in overhead lowering devices to prevent rapid lowering movement of a load carried by a crane or the like.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

Having thus described my invention, I now claim:

1. An automatic locking device for a pair of elongated inner and outer members movable longitudinally relative to one another in first and second opposite directions between extended and retracted positions, said locking device including friction brake means between said members operative automatically in response to initial relative movement between said member in one of said directions for locking said members against further relative movement in said one direction free relative movement between said members in the other of said directions, selectively operable releasing means for releasing said brake means to provide free relative movement between said members in said one direction, said releasing means being movable between brake armed and brake releasing positions, automatic operating means for moving said releasing means from said brake releasing to said brake armed position, said operating means being movable between operated and operating positions, said operating means being automatically moved to said operating position upon movement of said members in said one direction to one of said positions when said releasing means is in said brake releasing position, and said operating means being automatically movable to said operated position for moving said releasing means to said brake armed position upon relative movement between said members in said other direction from said one position.

2. The device of claim 1 wherein said brake means is carried by one of said members and including cooperating cam means between said brake means and said one member for automatically moving said brake means into locking engagement between said members in said one direction when said releasing means is in said brake armed position.

3. The device of claim 1 wherein said members are tubular and said releasing means includes an elongated rod positioned within said members and having one rod end portion within said members carrying said brake means, said rod being longitudinally movable relative to said members for moving said brake means between brake armed and brake releasing positions.

4. A safety lock device for lifts or the like comprising; an elongated inner member received within an outer member for extension and retraction relative thereto between fully retracted and fully extended positions, brake means carried by said inner member within said outer member for locking said inner member against retraction movement from substantially any extended position thereof beyond said fully retracted position, releasing means for releasing said brake means and being movable between brake arming and releasing positions, said releasing means being in said releasing position in said fully retracted position of said inner member, and operating means responsive to extension movement of said inner member from said fully retracted position for moving said releasing means to said arming position.

5. The device of claim 4 wherein said operating means is movable between operating and operated positions, said operating means being placed in said operating position during final retracting movement of said inner member to said fully retracted position and being movable to said operated position to move said releasing means to said arming position in response to extension movement of said inner member from said fully retracted position.

6. The device of claim 4 wherein said releasing means comprises a pivoted lever carried by said inner member and said operating means comprises a torsion spring carried by said inner member, said lever in said brake releasing position thereof being received within said outer member, said spring being automatically torqued upon final retraction movement of said inner member to said fully retracted position for biasing against said lever which is in said brake releasing position for pivoting same to said brake arming position when said inner member is extended from said fully retracted position and said lever moves out of said outer member.

7. A safety lock device for lifts or the like comprising; vertically positioned inner and outer members, said inner member having an inner end portion received in said outer member and being movable extensibly and retractably relative to said outer member between fully retracted and fully extended positions, an elongated rod extending through said inner member and carrying brake segments thereon for generally radial movement within said outer member beyond said inner end portion of said inner member, cam means carried by said inner end portion of said inner member for cooperation with said brake segments, biasing means for normally biasing said rod upwardly relative to said inner member for moving said brake segments toward said cam means to move said brake elements outwardly into engagement with said outer member, said rod being movable downwardly for moving said brake segments away from said cam means to move said brake segments inwardly away from said outer member, a lever pivoted to said inner member on a generally horizontal lever pivot axis, said rod having an upper end portion pivotally connected with said lever by a rod pivot connection which is eccentric to said lever pivot axis, said lever being pivotable in opposite directions between brake disengaged and brake armed positions for moving said rod downwardly or upwardly, and said rod pivot connection being in over center positions on opposite sides of a vertical axis through said lever pivot axis when said lever is in said brake disengaged and armed positions.

8. The device of claim 7 wherein said lever is releasably held in said brake disengaged position against a stop on said inner member by the biasing force of said spring, and a torsion spring carried by the pivot connection between said lever and said inner member, said torsion spring being torqued upon final movement of said inner member toward said fully retracted position for automatically pivoting said lever to said brake armed position upon extensible movement of said inner member from said fully retracted position.

9. In a vehicle lift or the like movable between fully lowered and fully elevated positions relative to a supporting surface, a safety lock device for locking said lift against unintentional lowering movement, said safety lock device including an elongated hollow outer member embedded within said supporting surface, an elongated inner member having an outer end portion connected with said lift and an inner end portion received within said outer member for extension and retraction of said inner member relative to said outer member during raising and lowering movement of said lift, brake means carried by said inner end portion of said inner member for cooperation with said outer member and being movable between brake armed and released positions, said brake means in said armed position providing free extension of said inner member relative to said outer member during raising movement of said lift and being automatically operative in response to initial lowering movement of said lift from substantially any elevated position thereof above said fully lowered position to lock said inner member against retraction within said outer member, said brake means in said released position providing free extension and retraction of said inner member relative to said outer member, releasing means carried by said inner member for movement outwardly and inwardly relative to said inner member between brake arming and releasing positions for placing said brake means in said brake armed and released positions, said releasing means in said releasing position being moved inwardly relative to said inner member and being receivable within said outer member in said fully retracted position of said lift, and operating means for automatically moving said releasing means outwardly relative to said inner member to said arming position as said releasing means moves out of said outer member during raising movement of said lift.

10. The lift of claim 9 wherein said operating means comprises a spring carried by said inner member and being stressed and held stressed by engagement with said outer member during final movement of said lift toward said fully lowered position for biasing against said releasing means to move said releasing means to said arming position when said releasing means clears said outer member during raising movement of said lift.

* * * * *